US010746497B2

(12) United States Patent
Shaffer et al.

(10) Patent No.: US 10,746,497 B2
(45) **Date of Patent: *Aug. 18, 2020**

(54) MID-LIMB CAM CROSSBOW SYSTEM

(71) Applicant: Hunter's Manufacturing Company, Inc., Suffield, OH (US)

(72) Inventors: Michael Shaffer, Mogadore, OH (US); Dean Mook, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/372,850

(22) Filed: Apr. 2, 2019

(65) Prior Publication Data

US 2019/0301829 A1 Oct. 3, 2019

Related U.S. Application Data

(60) Provisional application No. 62/651,877, filed on Apr. 3, 2018.

(51) Int. Cl.
*F41B 5/12* (2006.01)

(52) U.S. Cl.
CPC ..... *F41B 5/123* (2013.01)

(58) Field of Classification Search
CPC ..... F41B 5/10; F41B 5/12; F41B 5/123
See application file for complete search history.

(56) References Cited

U.S. PATENT DOCUMENTS 2,092,361 A 9/1937 Shirn
3,043,287 A 7/1962 Nelson
3,561,419 A 2/1971 Cucuzza, Sr.
3,670,711 A 6/1972 Firestone
3,739,765 A 6/1973 Moore
4,192,281 A 3/1980 King
4,246,883 A 1/1981 Ash
4,593,675 A 6/1986 Waiser
4,603,676 A 8/1986 Luoma
4,649,892 A 3/1987 Bozek
4,662,345 A 5/1987 Stephens
4,665,885 A 5/1987 Glomski et al.
(Continued)

OTHER PUBLICATIONS

A Guide to the Crossbow, by W.F. Paterson, published by the Society of Archer-Antiquaries, 1990.
(Continued)

*Primary Examiner* — John A Ricci
(74) *Attorney, Agent, or Firm* — Emerson Thomson Bennett

(57) ABSTRACT

A mid-limb cam crossbow system may comprise an elongated beam; a bow assembly engaged with the beam and having a pair of limbs; the pair of limbs being a first limb and a second limb, wherein the first limb has a proximate end and a distal end offset from the proximate end by a length L1, and the second limb has a proximate end and a distal end offset from the proximate end by a length L2. A first cam may be engaged with the first limb at a first cam mount point offset from the proximate end of the first limb by a length between (0.15)L1 and (0.75)L1. A second cam may be engaged with the second limb at a second cam mount point offset from the proximate end of the second limb by a length between (0.15)L2 and (0.75)L2.

12 Claims, 5 Drawing Sheets

(56) References Cited

U.S. PATENT DOCUMENTS

| | | | | |
|---|---|---|---|---|
| 4,719,897 | A | 1/1988 | Gaudreau | |
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,853,001 | A | 12/1998 | Vyprachticky | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,624,725 | B1 | 12/2009 | Choma | |
| 7,784,453 | B1 | 8/2010 | Yehle | |
| 8,443,790 | B2 | 5/2013 | Pestrue | |
| 8,499,753 | B2 | 8/2013 | Bednar | |
| 9,234,719 | B1 | 1/2016 | Kempf | |
| 9,255,753 | B2 * | 2/2016 | Pulkrabek | F41B 5/105 |
| 10,330,427 | B2 * | 6/2019 | Shaffer | F41B 5/123 |
| 2006/0086346 | A1 | 4/2006 | Middleton | |
| 2010/0170488 | A1 | 1/2010 | Rasor et al. | |
| 2019/0186865 | A1 * | 6/2019 | Pulkrabek | F41B 5/1469 |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

MID-LIMB CAM CROSSBOW SYSTEM

CROSS-REFERENCE TO RELATED APPLICATIONS

This application claims the benefit of U.S. Provisional Application No. 62/651,877, filed Apr. 3, 2018, the entirety of which is fully incorporated by reference herein.

BACKGROUND

The present subject matter is directed to apparatuses and methods regarding crossbows. More specifically the present subject matter is directed to apparatuses and methods for a crossbow having one or more cams supported along a limb offset from either end of the limb.

Crossbows have been used for many years as a weapon for hunting and fishing, and for target shooting. Typically, a crossbow may include a beam including a stock member and a barrel connected to the stock member. The barrel typically has an arrow receiving area for receiving an arrow to be shot. The crossbow may also include a bow assembly supported on the main beam that includes a bow and a bowstring connected to the bow for use in shooting arrows. A trigger mechanism, also supported on the main beam, holds the bowstring in a drawn or cocked condition and can thereafter be operated to release the bowstring out of the uncocked condition to shoot the arrow.

The configuration of the bow and bowstring strongly influence the energy storage capacity of the bow and the energy and power output of the crossbows. It remains desirable to produce a compact bow having sufficient energy storage capacity, energy and power output, and other defining operational characteristics.

SUMMARY

Provided is a mid-limb cam crossbow system that may comprise an elongated beam having a first beam end, and a second beam end opposite the first beam end; a bow assembly mounted to the beam at the first beam end, the bow assembly having a pair of limbs defining opposite ends of said bow assembly, the pair of limbs being a first limb and a second limb, wherein the first limb has a proximate end and a distal end offset from the proximate end by a length L1, and the second limb has a proximate end and a distal end offset from the proximate end by a length L2; a first cam rotatably engaged with the first limb at a first cam mount point offset from the proximate end of the first limb by a length between (0.15)L1 and (0.75)L1; a second cam rotatably engaged with the second limb at a second cam mount point offset from the proximate end of the second limb by a length between (0.15)L2 and (0.75)L2.

Also provided is a method of using a mid-limb cam crossbow system that may comprise providing a mid-limb cam crossbow system having an elongated beam having a first beam end, and a second beam end opposite the first beam end; a bow assembly mounted to the beam at the first beam end, the bow assembly having a pair of limbs defining opposite ends of said bow assembly, the pair of limbs being a first limb and a second limb, wherein the first limb has a proximate end and a distal end offset from the proximate end by a length L1, and the second limb has a proximate end and a distal end offset from the proximate end by a length L2; a first cam rotatably engaged with the first limb at a first cam mount point offset from the proximate end of the first limb by a length between (0.15)L1 and (0.75)L1; a second cam rotatably engaged with the second limb at a second cam mount point offset from the proximate end of the second limb by a length between (0.15)L2 and (0.75)L2.

Also provided is a mid-limb cam crossbow system that may comprise an elongated beam having a first beam end, and a second beam end opposite the first beam end; a bow assembly mounted to the beam at the first beam end, the bow assembly having a pair of limbs defining opposite ends of said bow assembly, the pair of limbs being a first limb and a second limb, wherein the first limb has a proximate end and a distal end offset from the proximate end by a length L1, and the second limb has a proximate end and a distal end offset from the proximate end by a length L2; a first cam rotatably engaged with the first limb at a first cam mount point offset from the proximate end of the first limb by a length between (0.15)L1 and (0.75)L1; a second cam rotatably engaged with the second limb at a second cam mount point offset from the proximate end of the second limb by a length between (0.15)L2 and (0.75)L2; a first power cord operatively engaged between the first power cord mount and the second cam, wherein the first power cord mount is offset from the proximate end of the first limb by a length of greater than (0.75)L1; a second power cord operatively engaged between the second power cord mount and the first cam, wherein the second power cord mount is offset from the proximate end of the second limb by a length of greater than (0.75)L2; a bow string adapted to propel an arrow, the bowstring operatively engaged between the first cam and the second cam; and wherein, the first cam mount point is adapted to be selectable located along the first limb at any of a plurality of engagement points defined by discrete holes in the first limb, and the second cam mount point is adapted to be selectable located along the second limb at any of a plurality of engagement points defined by discrete holes in the second limb.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
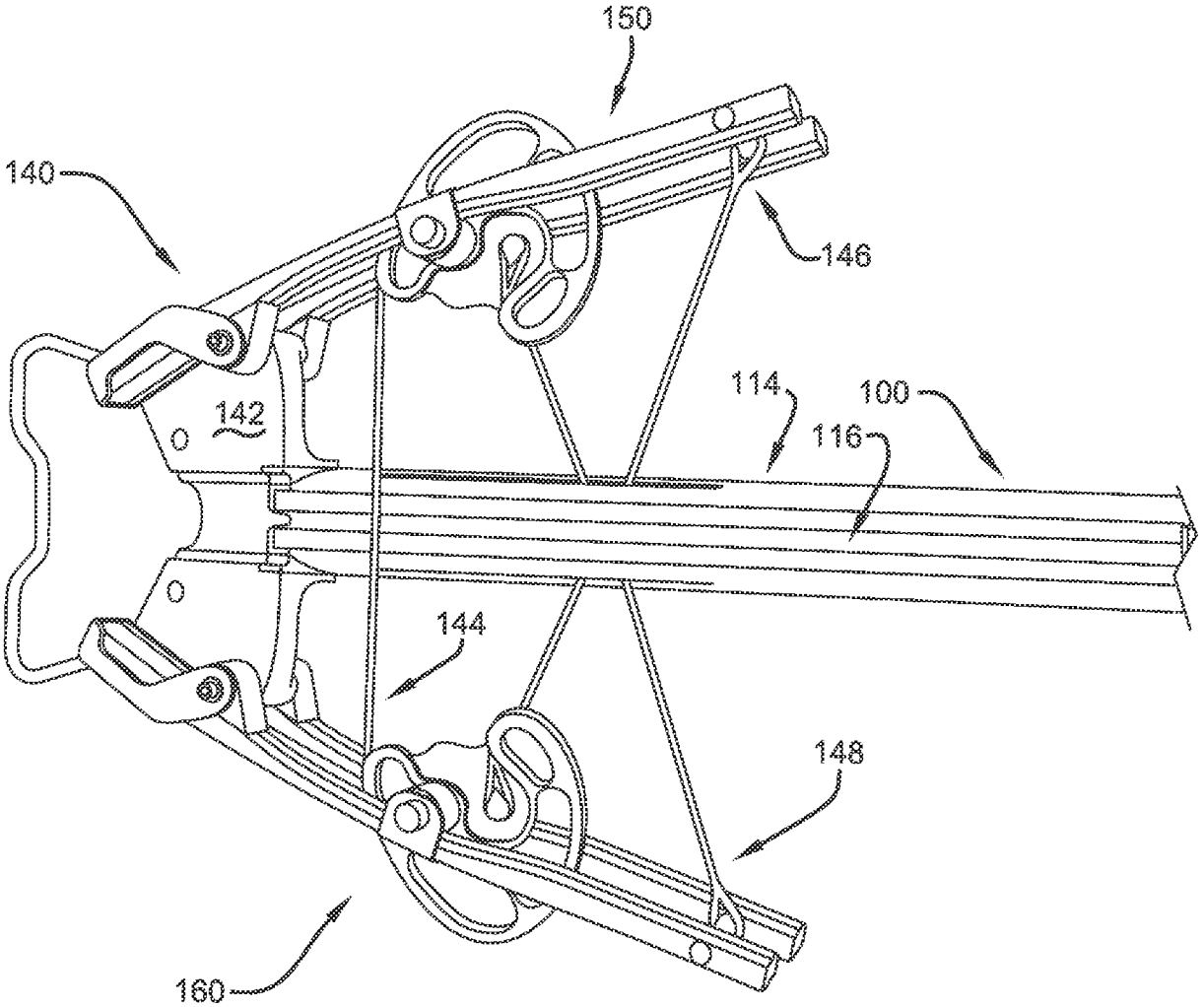
FIG. 1 is a top view of one embodiment of a crossbow comprising a mid-limb cam crossbow system.

Referring now to the drawings wherein the showings are for purposes of illustrating embodiments of the present subject matter only and not for purposes of limiting the same, and wherein like reference numerals are understood to refer to like components, provided is a mid-limb cam crossbow system and a method for using same.

In a first embodiment, a mid-limb cam crossbow system 100 may comprise a beam 110 and a bow assembly 140.

In the first embodiment, the beam 110 may be elongated. The beam 110 may include a stock member 112, and a barrel 114. The barrel 114 may be connected to the stock member 112. The barrel 114 may have an arrow receiver region 116 adapted to receive an associated arrow (not shown). The beam 110 may have a first beam end 117 and a second beam end 118 opposite the first beam end 117.

The bow assembly 140 is mounted to the beam 110 at the first beam end 117. The bow assembly 140 may comprise a riser 142 engaged with the barrel 114. The riser 142 may operatively engage both a first limb assembly 150, and a second limb assembly 160, to the beam 110. The bow assembly 140 may further comprise a first power cord 146, a second power cord 148, and a bow string 144.

The first limb assembly 150 comprises an elongated first limb 151 defining a first end 152 and a second end 155 offset from the first end 152 by the length L1 of the elongated first limb 151. The first limb assembly 150 is rotatably engaged to the riser 142 at a first axis 154 proximate to the first end 152. The first end 152, may also be referred to herein as the proximate end 152 of the first limb 151. The first limb assembly 150 further comprises a first power cord mount 158. The first limb assembly 150 further comprises a first cam 156 rotatably engaged with the first limb 151 at a first cam mount point 159 between the first axis 154 and the first power cord mount 158 and substantially offset from each.

In some embodiments the first cam 156 is rotatably engaged with the first limb 151 at a first cam mount point 159 midway between the first axis 154 and the first power cord mount 158. In some embodiments, the first cam 156 is rotatably engaged with the first limb 151 at a first cam mount point 159 offset from the proximate end 152 of the first limb by a length between (0.15)L1 and (0.75)L1.

The second limb assembly 160 comprises an elongated second limb 161 defining a first end 162 and a second end 165 offset from the first end 162 by the length L2 of the elongated second limb 161. The second limb assembly 160 is rotatably engaged to the riser 142 at a second axis 164 proximate to the first end 162. The first end 162, may also be referred to herein as the proximate end 162 of the second limb 161. The second limb assembly 160 further comprises a second power cord mount 168. The first limb assembly 160 further comprises a second cam 166 rotatably engaged with the second limb 161 at a second cam mount point 169 between the second axis 164 and the second power cord mount 168 and substantially offset from each. In some embodiments, the second cam 166 is rotatably engaged with the second limb 161 at a second cam mount point 169 offset from the proximate end 162 of the second limb by a length between (0.15)L2 and (0.75)L2.

The bow string 144 may be operatively engaged between the first cam 156 and the second cam 166. The first power cord 146 may be operatively engaged between the first power cord mount 158 and the second cam 166. The second power cord 148 may be operatively engaged between the second power cord mount 168 and the first cam 156. The bow limbs 151, 161 define opposite ends of the bow assembly 140. In some embodiments, the first power cord mount 158 is offset from the proximate end of the first limb 152 by a length of greater than (0.75)L1. In some embodiments, the second power cord mount 168 is offset from the proximate end of the second limb 162 by a length of greater than (0.75)L2.

Location of the first cam 156 between the first axis 154 and the first power cord mount 158, or location of the second cam 166 between the second axis 164 and the second power cord mount 168 may permit the designer additional latitude in providing desirable performance, size and weight.

Figure 2:
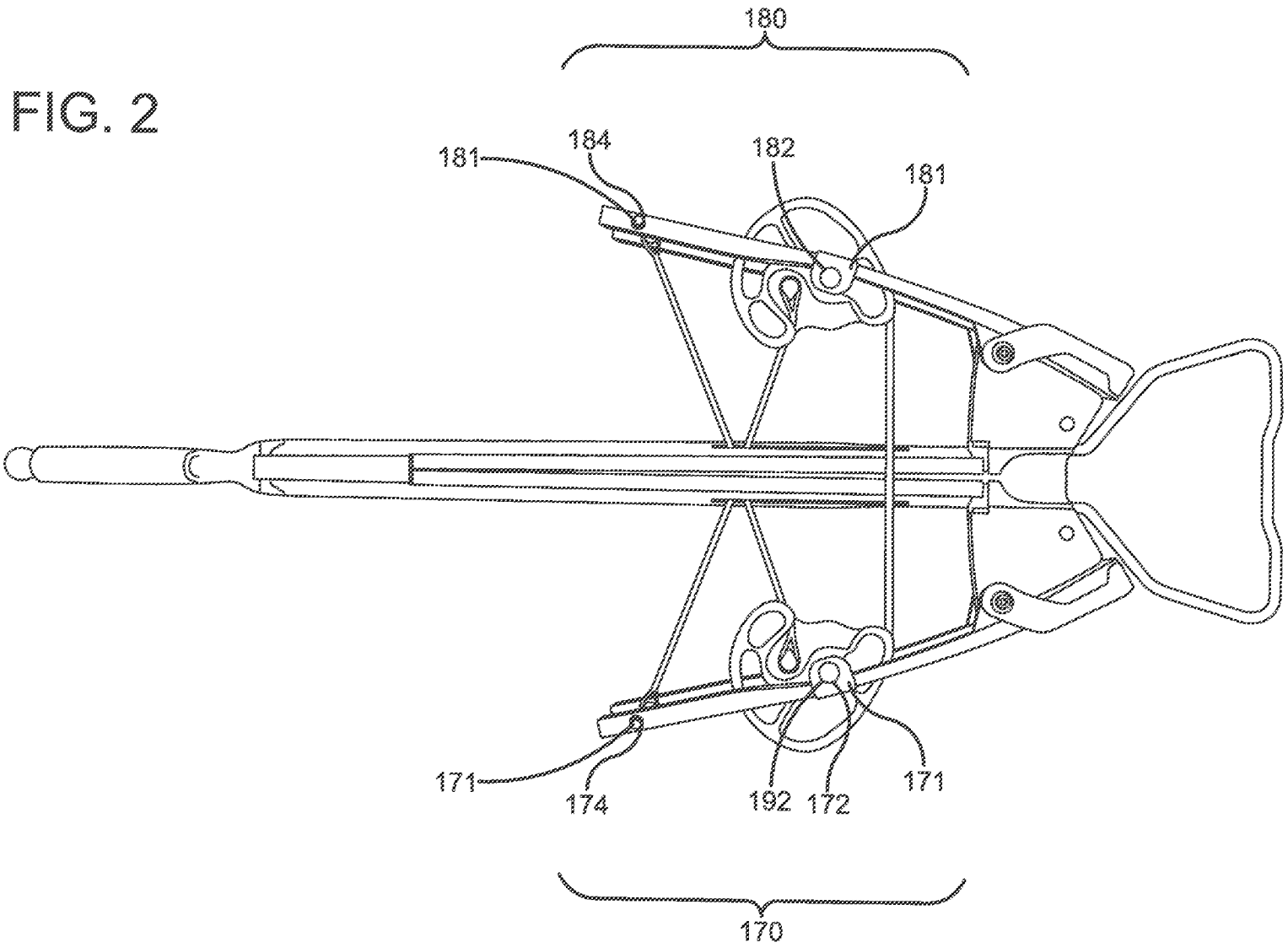
FIG. 2 is another top view of the embodiment of FIG. 1 of a crossbow comprising a mid-limb cam crossbow system.
Figure 3:
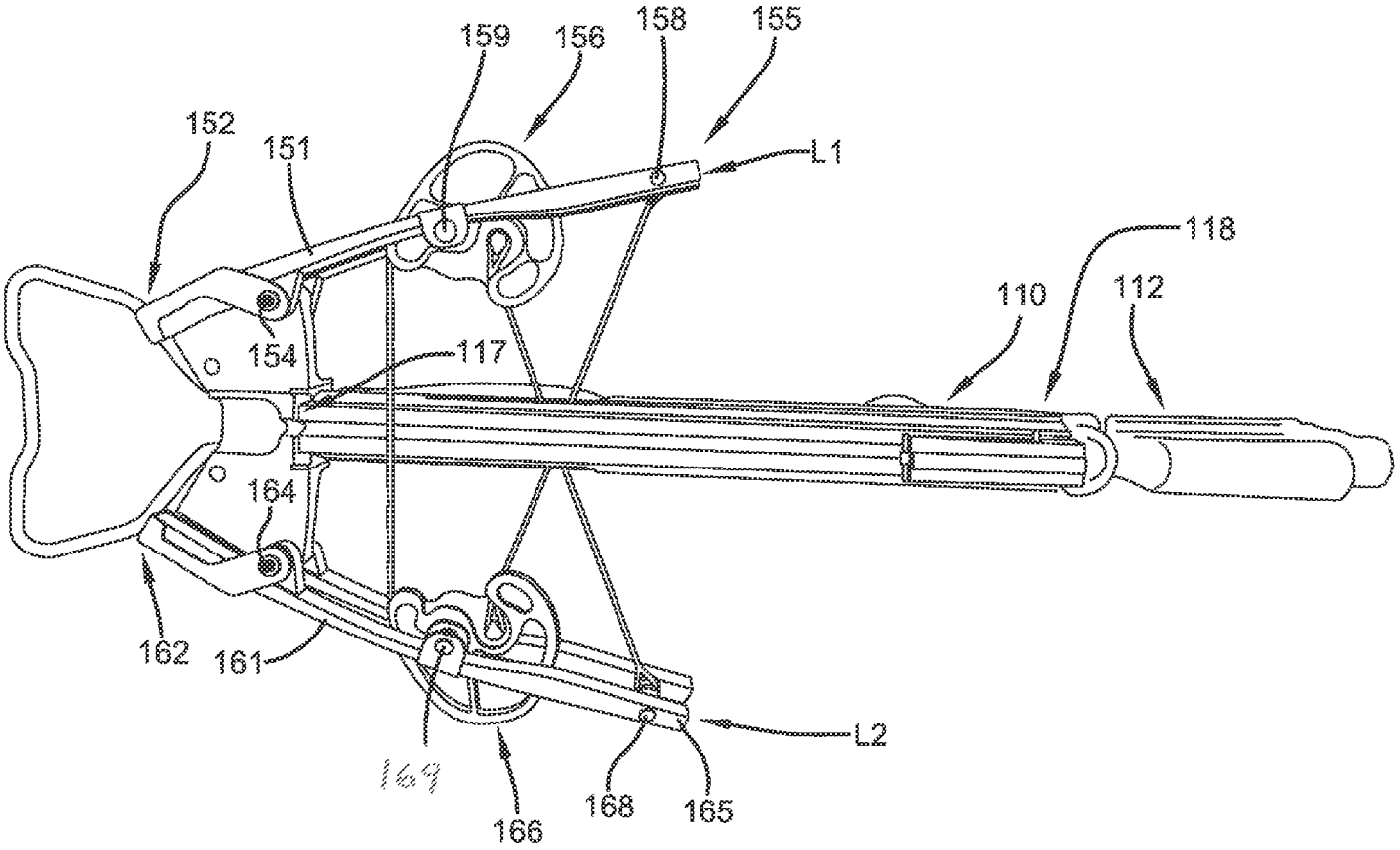
FIG. 3 is another top view of the embodiment of FIG. 1 of a crossbow comprising a mid-limb cam crossbow system.
Figure 4:
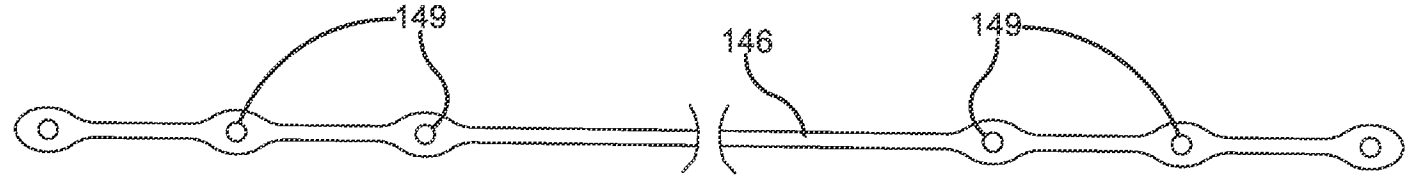
FIG. 4 shows a power cord with adaptations to permit the operational length of the first power cord to be modified by a user.

In some embodiments the first limb 151 may comprise a first set of engagement points 170 comprising a plurality of engagement points 171. In the embodiment shown in FIGS. 1-3, the first set of engagement points 170 comprises an engagement point 172 and an engagement point 174. In some embodiments, the first set of engagement points 170 may comprise an engagement point 172, an engagement point 174, and at least one additional engagement point 176. A first set of engagement points 170 may comprise two engagement points 171, three engagement points 171, four engagement points 171, five engagement points 171, six engagement points 171, or more than six engagement points 171. In embodiments with more than one engagement point 171, a user has the option to modify the assembly of the crossbow by choosing at which of multiple engagements point 171 to engage the first cam 156 and by choosing at which of multiple engagements point 171 to engage the first power cord mount 158. As shown in FIG. 2, the first cam 156 may be engaged with first limb 151 at a first cam mount point 159 coinciding with engagement point 172. The first cam 156 in FIG. 2 may be alternatively engaged at a first cam mount point 159 coinciding with engagement point 174. Engagement of the first cam 156 to the first limb 151 may be by a bolt, pin, spring clip, or other selectably engageable mechanical fastener 192 adapted to permit a user to selectably engage or disengage the first cam 156. In some embodiments, the user may readily move the first cam 156 between engagements points 171. As shown in FIG. 2, the first power cord 146 may be engaged with first limb 151 at a first power cord mount 158 coinciding with engagement point 174. The first power cord 146 in FIG. 2 may be alternatively engaged at a first power cord mount 158 coinciding with engagement point 172. Engagement of the first power cord 146 to the first limb 151 may be by a bolt, pin, spring clip, or other selectably engageable mechanical fastener 192 adapted to permit a user to selectably engage or disengage the first power cord 146. In some embodiments, the user may readily move the first power cord 146 between engagements points 171. The first power cord 146 may comprise one or more adaptations to permit the operational length to be modified by a user. As shown in FIG. 4, adaptations to permit the operational length of the first power cord 146 to be modified by a user may include intermediate engagement elements 149 along the first power cord 146.

Figure 5:
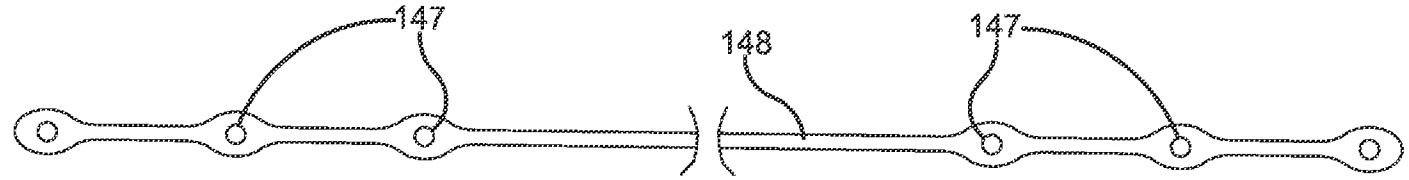
FIG. 5 shows a power cord with adaptations to permit the operational length of the first power cord to be modified by a user.
Figure 6:
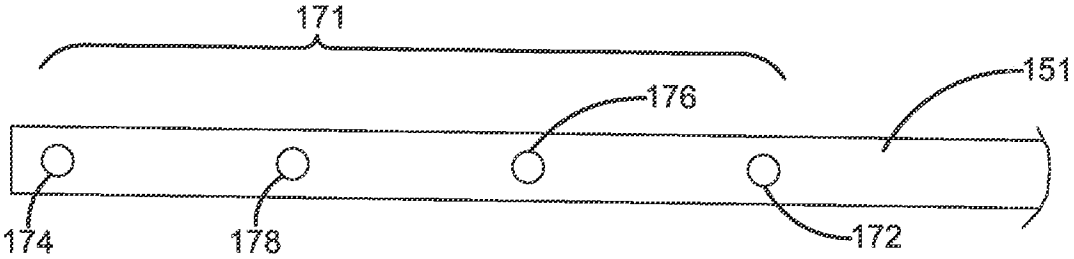
FIG. 6 shows a first limb with a plurality of engagement points.
Figure 7:
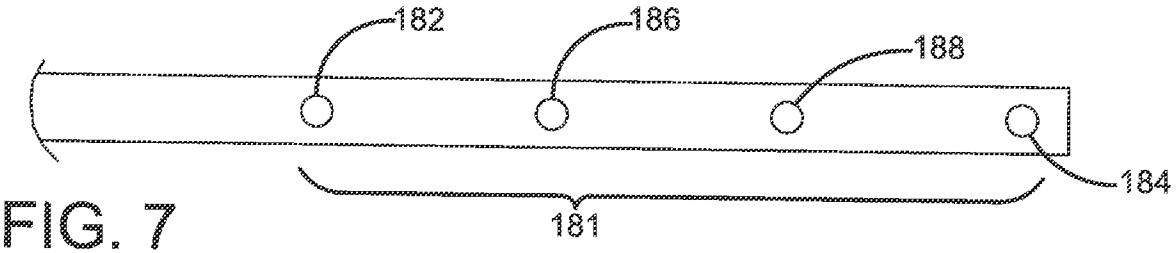
FIG. 7 shows a second limb with a plurality of engagement points.

In some embodiments the second limb 161 may comprise a second set of engagement points 180 comprising a plurality of engagement points 181. In the embodiment shown in FIGS. 1-3, the second set of engagement points 180 comprises engagement point 182 and engagement point 184. In some embodiments, the second set of engagement points 180 may comprise an engagement point 182, an engagement point 184, and at least one additional engagement point 186. A second set of engagement points 180 may comprise two engagement points 181, three engagement points 181, four engagement points 181, five engagement points 181, six engagement points 181, or more than six engagement points 181. In embodiments with more than one engagement point 181, a user has the option to modify the assembly of the crossbow by choosing at which of multiple engagements point 181 to engage the second cam 166 and by choosing at which of multiple engagements point 181 to engage the second power cord mount 168. As shown in FIG. 2, the second cam 166 may be engaged with second limb 161 at a second cam mount point 169 coinciding with engagement point 182. The second cam 166 in FIG. 2 may be alternatively engaged at a second cam mount point 169 coinciding with engagement point 184. Engagement of the second cam 166 to the second limb 161 may be by a bolt, pin, spring clip, or other selectably engageable mechanical fastener 192 adapted to permit a user to selectably engage or disengage the second cam 166. In some embodiments, the user may readily move the second cam 166 between engagements points 181. As shown in FIG. 2, the second power cord 148 may be engaged with second limb 161 at a second power cord mount 168 coinciding with engagement point 184. The second power cord 148 in FIG. 2 may be alternatively engaged at a second power cord mount 168 coinciding with engagement point 182. Engagement of the second power cord 148 to the second limb 161 may be by a bolt, pin, spring clip, or other selectably engageable mechanical fastener adapted to permit a user to selectably engage or disengage the second power cord 148. In some embodiments, the user may readily move the second power cord 148 between engagements points 181. The second power cord 148 may comprise one or more adaptations to permit the operational length to be modified by a user. As shown in FIG. 5, adaptations to permit the operational length of the second power cord 148 to be modified by a user may include intermediate engagement elements 147 along the second power cord 148.

A user may modify a mid-limb cam crossbow system 100 by moving the cams 156, 166 between engagement points 171, 181 or engaging the power cords 146, 148 to different engagement points 171, 181. Such modification may tailor crossbow performance to suit the user by changing the work needed to cock the crossbow or by changing the maximum force needed to cock the crossbow, or by changing the power stroke distance, or by changing the output speed or energy imparted to a fired arrow, or some combination thereof. Such ready user modification may be of particular interest to the young or novice user that may desire a crossbow able to change as the user's proficiency and capacity grows.

Similarly, a user may modify a mid-limb cam crossbow system 100 to replace existing cams 156, 166 with different cams (not shown) having a different profile or operative characteristics. Similarly, a user may modify a mid-limb cam crossbow system 100 to replace existing power cords 146, 148 with different power cords (not shown) having a different length or operative characteristics.

Figure 8:
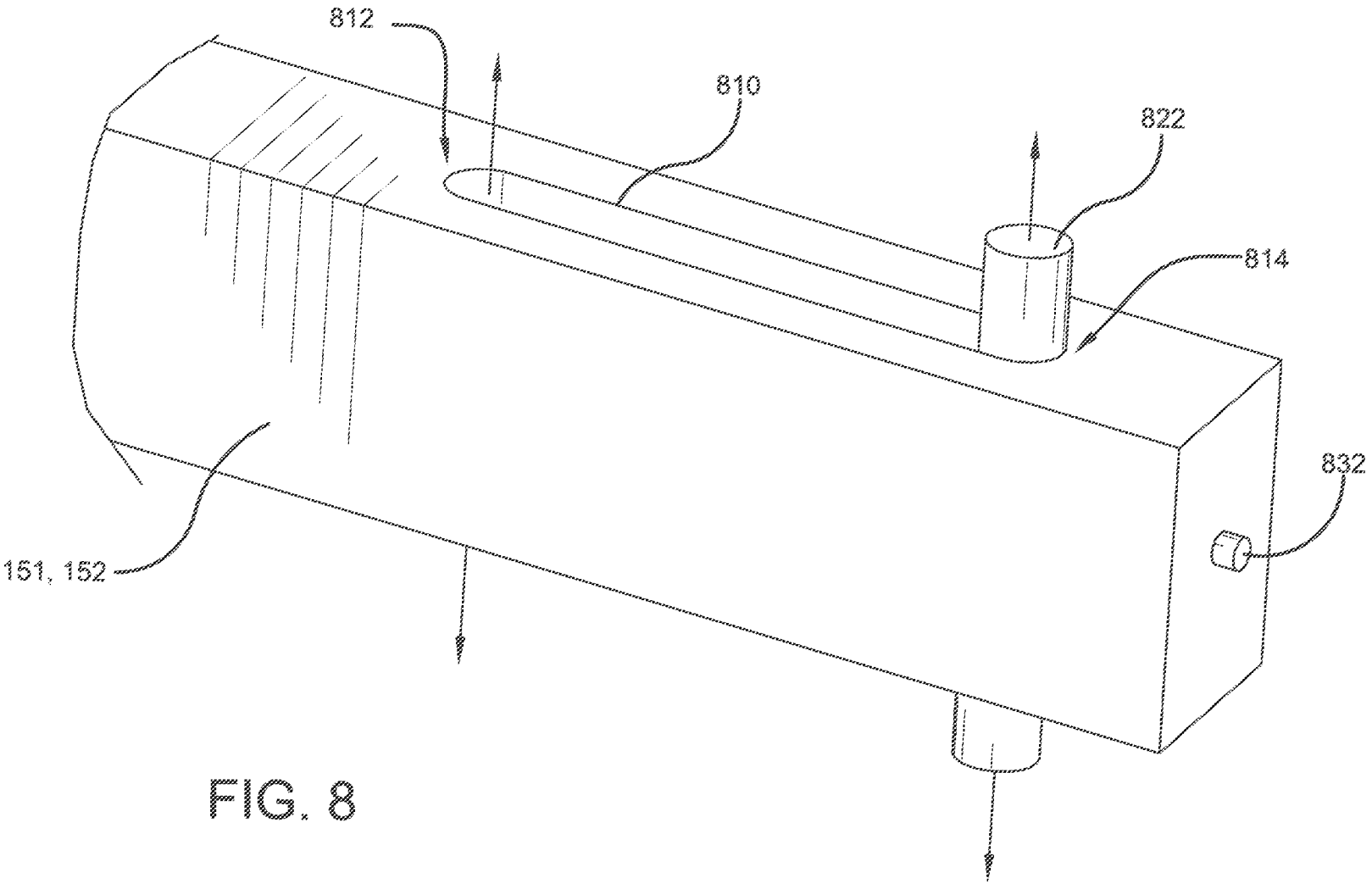
FIG. 8 shows an optional assembly for a bow limb.

In some non-limiting embodiments an engagement point 171, 181 for a power cord may be adjustable such that the position of the engagement point 171, 181 may be selectable by a user. Referring now to FIG. 8, shown is an optional assembly wherein a bow limb 151, 152 comprises an elongated slot 810 in which a pin 822 or other similar mechanical fastener may be selectably located between a first slot end 812 and a second slot end 814 opposite the first slot end. In some non-limiting embodiments the pin 822 may be operationally engaged with a screw 832 or other threaded adapted to selectably position the pin 822 at a user desired location between first slot end 812 and second slot end 814 by operationally rotating the screw 832. In some embodiments adjustment of the position of the engagement point 171, 181 may adjust the tension in a power cord 146, 148 operationally engaged therewith.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

What is claimed is:

1. A mid-limb cam crossbow system comprising:

an elongated beam having a first beam end, and a second beam end opposite the first beam end;

a bow assembly mounted to the beam at the first beam end, the bow assembly having a pair of limbs defining opposite ends of said bow assembly, the pair of limbs being a first limb and a second limb, wherein the first limb has a proximate end and a distal end offset from the proximate end by a length L1, and the second limb has a proximate end and a distal end offset from the proximate end by a length L2;

a first cam rotatably engaged with the first limb at a first cam mount point offset from the proximate end of the first limb by a length between (0.15)L1 and (0.75)L1;

a second cam rotatably engaged with the second limb at a second cam mount point offset from the proximate end of the second limb by a length between (0.15)L2 and (0.75)L2; and a first power cord operatively engaged between a first power cord mount and the second cam, wherein the first power cord mount is offset from the proximate end of the first limb by a length of greater than (0.75)L1.

2. The mid-limb cam crossbow system of claim 1, further comprising a second power cord operatively engaged between the second power cord mount and the first cam, wherein the second power cord mount is offset from the proximate end of the second limb 162 by a length of greater than (0.75)L2.

3. The mid-limb cam crossbow system of claim 2, further comprising a bow string adapted to propel an arrow, the bowstring operatively engaged between the first cam and the second cam.

4. The mid-limb cam crossbow system of claim 3 wherein, the first cam mount point is adapted to be selectable located along the first limb at any of a plurality of engagement points defined by discrete holes in the first limb.

5. The mid-limb cam crossbow system of claim 4 wherein, the second cam mount point is adapted to be selectable located along the second limb at any of a plurality of engagement points defined by discrete holes in the second limb.

6. A method of using a mid-limb cam crossbow system comprising:

providing a mid-limb cam crossbow system having an elongated beam having a first beam end, and a second beam end opposite the first beam end;

a bow assembly mounted to the beam at the first beam end, the bow assembly having a pair of limbs defining opposite ends of said bow assembly, the pair of limbs being a first limb and a second limb, wherein the first limb has a proximate end and a distal end offset from the proximate end by a length L1, and the second limb has a proximate end and a distal end offset from the proximate end by a length L2;

a first cam rotatably engaged with the first limb at a first cam mount point offset from the proximate end of the first limb by a length between (0.15)L1 and (0.75) L1; and a second cam rotatably engaged with the second limb at a second cam mount point off set from the proximate end of the second limb by a length between (0.15)L2 and (0.75)L2; and a first power cord operatively engaged between a first power cord mount and the second cam, wherein the first power cord mount is offset from the proximate end of the first limb by a length of greater than (0.75)L1.

7. The method of using a mid-limb cam crossbow system of claim 6, further comprising a second power cord operatively engaged between the second power cord mount and the first cam, wherein the second power cord mount is offset from the proximate end of the second limb 162 by a length of greater than (0.75)L2.

8. The method of using a mid-limb cam crossbow system of claim 7, further comprising a bow string adapted to propel an arrow, the bowstring operatively engaged between the first cam and the second cam.

9. The method of using a mid-limb cam crossbow system of claim 8, wherein, the first cam mount point is adapted to be selectable located along the first limb at any of a plurality of engagement points defined by discrete holes in the first limb.

10. The method of using a mid-limb cam crossbow system of claim 9, wherein, the second cam mount point is adapted to be selectable located along the second limb at any of a plurality of engagement points defined by discrete holes in the second limb.

11. The method of using a mid-limb cam crossbow system of claim 10, further comprising cocking the crossbow.

12. A mid-limb cam crossbow system comprising:

an elongated beam having a first beam end, and a second beam end opposite the first beam end;

a bow assembly mounted to the beam at the first beam end, the bow assembly having a pair of limbs defining opposite ends of said bow assembly, the pair of limbs being a first limb and a second limb, wherein the first limb has a proximate end and a distal end offset from the proximate end by a length L1, and the second limb has a proximate end and a distal end offset from the proximate end by a length L2;

a first cam rotatably engaged with the first limb at a first cam mount point offset from the proximate end of the first limb by a length between (0.15)L1 and (0.75)L1;

a second cam rotatably engaged with the second limb at a second cam mount point offset from the proximate end of the second limb by a length between (0.15)L2 and (0.75)L2;

a first power cord operatively engaged between a first power cord mount and the second cam, wherein the first power cord mount is offset from the proximate end of the first limb by a length of greater than (0.75)L1;

a second power cord operatively engaged between a second power cord mount and the first cam, wherein the second power cord mount is offset from the proximate end of the second limb 162 by a length of greater than (0.75)L2;

a bow string adapted to propel an arrow, the bowstring operatively engaged between the first cam and the second cam; and wherein, the first cam mount point is adapted to be selectable located along the first limb at any of a plurality of engagement points defined by discrete holes in the first limb, and the second cam mount point is adapted to be selectable located along the second limb at any of a plurality of engagement points defined by discrete holes in the second limb.

* * * * *